United States Patent [19]

Seki

[11] Patent Number: 4,571,806

[45] Date of Patent: Feb. 25, 1986

[54] APPARATUS FOR ASSEMBLING BUTTONS

[75] Inventor: Fumio Seki, Toyama, Japan

[73] Assignee: Nippon Notion Kogyo Co., Ltd., Tokyo, Japan

[21] Appl. No.: 624,819

[22] Filed: Jun. 26, 1984

[30] Foreign Application Priority Data

Jul. 8, 1983 [JP] Japan ..... 58-106308[U]

[51] Int. Cl.[4] ..... B23P 19/02

[52] U.S. Cl. ..... 29/251; 29/267

[58] Field of Search ..... 100/257, 281; 29/267, 29/251, 252, 244

[56] References Cited

U.S. PATENT DOCUMENTS 1,610,327 12/1926 Seawell ..... 29/267

2,412,924 12/1946 Stover ..... 100/281

4,097,318 6/1978 Olschewski et al. ..... 100/281

4,360,335 11/1982 West ..... 100/281

*Primary Examiner*—Robert C. Watson

*Attorney, Agent, or Firm*—Hill, Van Santen, Steadman & Simpson

[57] ABSTRACT

A fastener assembling apparatus includes a shock absorber disposed between a frame of the apparatus and one lever of a toggle joint, the other lever of the toggle joint being connected to a punch assembly. The shock absorber is elastically deformable to absorb shock forces caused in the punch assembly by pressing of a pair of fastener elements between the punch assembly and a cooperating die assembly. The shock absorber may have means for adjusting the stroke of the punch assembly for accommodating changes in thicknesses of both the fastener elements and a garment to which the fastener elements are attached.

4 Claims, 4 Drawing Figures

APPARATUS FOR ASSEMBLING BUTTONS

BACKGROUND OF THE INVENTION

1. Field of the Invention

This invention relates generally to an apparatus for assembling a pair of fastener elements of a fastener such as a snap fastener, button, ornament or the like, and more particularly to such an apparatus having a toggle mechanism actuatable for reciprocating a punch to assemble the two fastener elements in clinched condition either with or without a garment sandwiched therebetween.

2. Description of the Prior Art

Various fastener assembling apparatus are known in which a toggle mechanism is actuated to move a reciprocable punch toward a die to force a pair of fastener elements in clinched engagement either with or without a garment sandwiched therebetween. The toggle mechanism includes a pair of bars pivotably connected together at one end which is coupled to a driving source such as a fluid-actuated cylinder. The free ends of the bars are pivoted respectively to a frame of the apparatus and the punch. The punch thus coupled with the toggle mechanism has a fixed stroke so that the apparatus is not suitable for assembling fastener elements varying in thicknesses and for attaching fastener elements to garments varying in thickness. When the fastener elements to be assembled jointly have a greater thickness, they are likely to be deformed due to undue forces applied thereto between the punch and the die. Alternatively, the fastener elements are insufficiently engaged when they jointly have a smaller thickness.

SUMMARY OF THE INVENTION

A fastener assembling apparatus includes a shock absorber disposed between a frame of the apparatus and one lever of a toggle joint, the other lever of the toggle joint being connected to a punch assembly. The shock absorber is elastically deformable to absorb shock forces caused in the punch assembly by pressing of a pair of fastener elements between the punch assembly and a cooperating die assembly. The shock absorber may include means for adjusting the stroke of the punch assembly for accomodating changes in thicknesses of both the fastener elements and a garment to which the fastener elements are attached.

An object of the present invention is to provide a fastener assembling apparatus capable of assembling fastener elements in neatly clinched condition without causing damage either to the fastener elements or to a garment fabric to which the fastener elements are attached.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
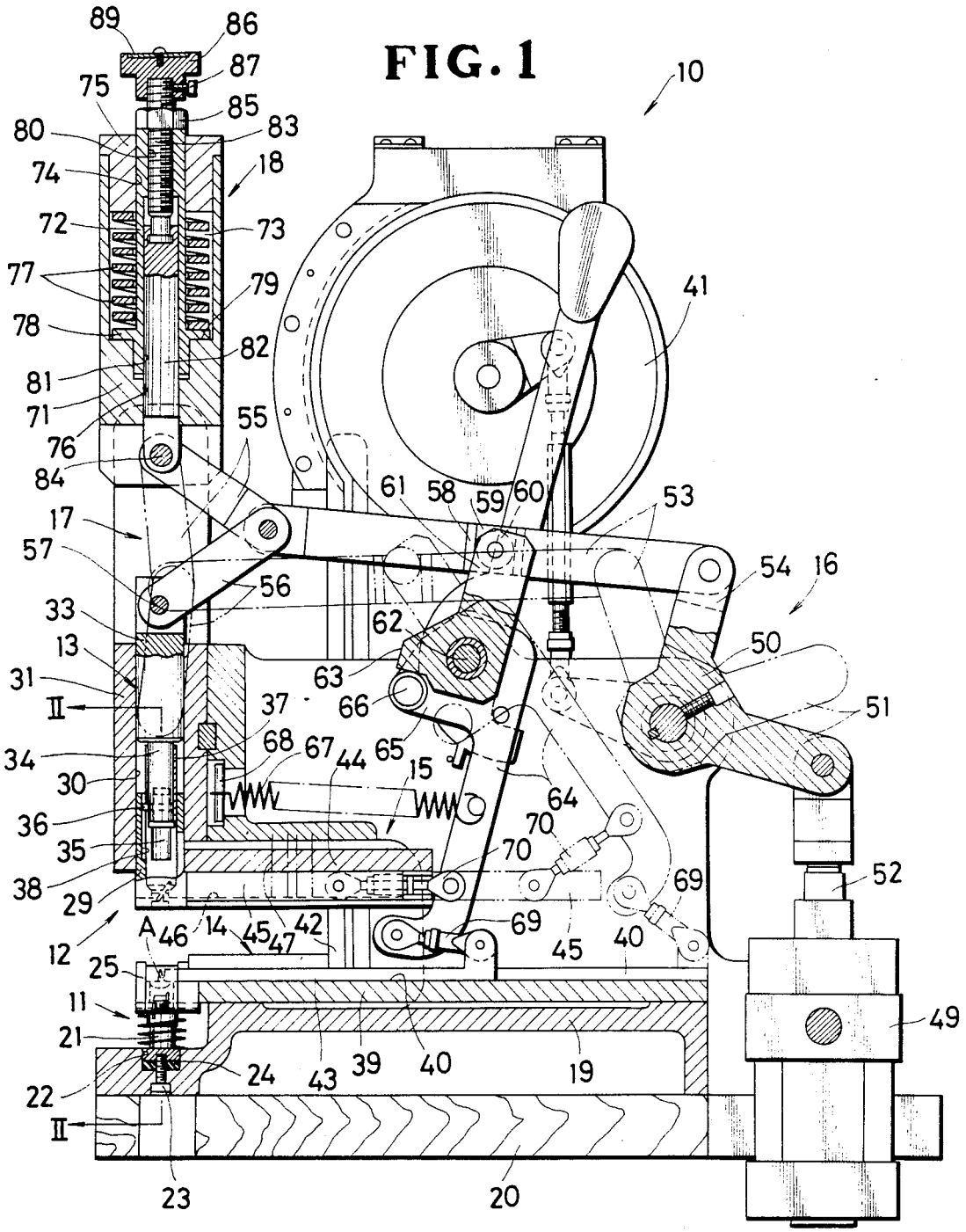
FIG. 1 is a side elevational view, partly in cross section, of an apparatus according to the present invention.

As shown in FIG. 1, an apparatus 10, constructed in accordance with the present invention, generally comprises a die assembly 11 for supporting thereon a fastener element A which is adapted to be clinched with a mating fastener element B (FIG. 2) to form a female member of a snap button (not shown), a gripping mechanism 12 for holding the fastener element B, a punch assembly 13 for forcing the fastener element B which is held on the gripping mechanism 12, against the fastener element A supported on the die mechanism 11, a first parts-supply mechanism 14 for feeding fastener elements A one at a time to the die assembly 11, a second parts-supply mechanism 15 for feeding the fastener elements B one at a time to the gripping mechanism 12, a drive mechanism 16 including a toggle joint 17 for reciprocating the punch mechanism 13 with respect to the die assembly 11, and a shock absorbing means 18 operatively connected to the toggle link 17, all the components 11–16 and 18 being mounted on a generally C-shaped frame 19 supported on a table 20.

Figure 2:
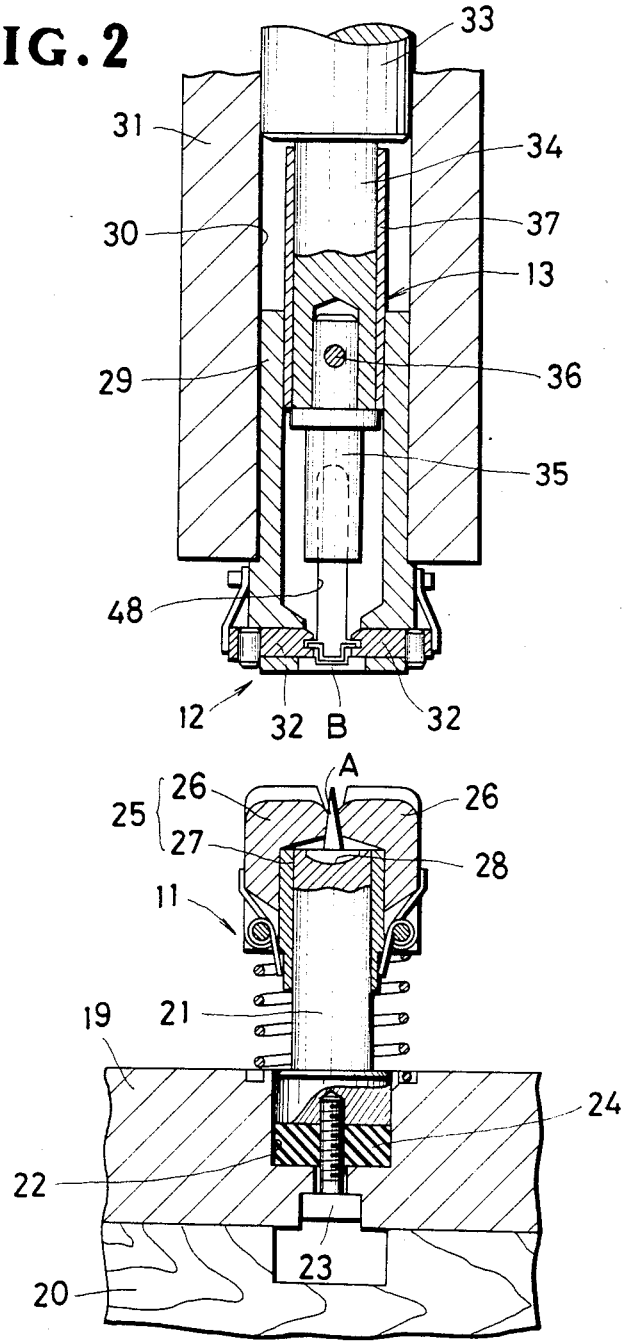
FIG. 2 is an enlarged fragmentary cross-sectional view taken along line II—II of FIG. 1.

The die assembly 11 includes a clinching die 21 fitted in a bore 22 in the frame 19 and secured to the frame 19 by means of a screw 23 with a rubber pad 24 interposed between the die 21 and the frame 19. The die assembly 11 further includes a clamp assembly 25 for releasably holding the fastener element A on the die 21. The clamp assembly 25, as shown in FIG. 2, includes a pair of inverted L-shaped clamp fingers 26, 26 pivoted in facing relation to a support block 27 fitted slidably over the die 21. The clamp fingers 26, 26 have respective distal end portions normally lying over the die 21 and urged toward each other to grip a shank of the fastener element A. The top surface of the die 21 is recessed as at 29 for receiving therein a head of the fastener element A.

The gripping mechanism 12 includes a tubular holder 29 slidably mounted in a vertical bore 30 formed in a head portion 31 of the C-shaped frame 19 in alignment with the die 21, and a pair of grip fingers 32, 32 (FIG. 2) slidably mounted in opposed relation in a lower exposed portion of the holder 29 and are urged toward each other to grip the head element B within the tubular holder 29.

The punch assembly 13 includes a plunger 33 slidably mounted in the vertical bore 30 above the tubular holder 29 and is reduced in diameter at one end to form a smaller-diameter portion 34 partly projecting into the tubular holder 29. A clinching punch 35 is connected to the small-diameter portion 34 by means of a pin 36. A split bush 37 is fitted over the small-diameter portion 34 throughout the length thereof and is connected thereto by the pin 36. The split bush 37 preferably is made of a strip of elastic metal such as spring steel and has an initial or undeformed inside diameter which is larger than the outside diameter of the plunger's small-diameter portion 34. Thus, when the split bush 37 is being compressedly fitted in the tubular holder 29, the holder 29 is frictionally supported on the split bush 37 under the resiliency of the latter. As shown in FIG. 1, the pin 36 projects through a longitudinal slot in the split bush 37 into an inner longitudinal guide groove 38 so as to prevent rotation of the holder 29 as the latter moves along with the plunger 33.

The first parts-supply mechanism 14, as shown in FIG. 1, comprises an elongate guide block 39 mounted on the frame 19 and having throughout the length thereof a guide channel 40 for receiving the fastener element A which is fed from a parts feeder 41 through a chute 42, and a reciprocable pusher bar 43 slidably mounted in the guide channel 40. The guide block 39 extends to the clamp assembly 25 for supplying the fastener element A on the clinching die 21.

Likewise, the second parts-supply mechanism 15 comprises an elongate guide block 44 mounted on the frame 19 and a reciprocable pusher bar 45 slidably mounted in a longitudinal guide channel 46 in the guide block 44. The fastener element B (FIG. 2) is supplied from a parts feeder (not shown) through a chute 47 to the guide channel 46. In order supply the fastener element B to the gripping assembly 12, the guide channel 46 is adapted to communicate at one end with a longitudinal opening 48 (FIG. 2) in the tubular holder 29 when the latter is located in the retracted position of FIG. 1.

As shown in FIG. 1, the drive mechanism 16 comprises a fluid-actuated cylinder 49 pivotally mounted on the frame 19, an L-shaped rocking lever 50 rockably mounted on the frame 19 and having one or a lower arm 51 pivotably connected to an end of a piston rod 52 of the cylinder 49, a connecting rod 53 pivotably connected at opposite ends to the other or an upper arm 54 of the rocking lever 50 and the pivot of the toggle joint 17. The toggle joint 17 has a structure well known per se and includes a pair of upper and lower levers 55, 56 pivoted together at one end. The free end of the lower lever 56 is pivotably connected to the upper end of the plunger 33 by means of a pin 57. A channel-shaped retainer 58 is secured to the connecting rod 53 substantially at the midpoint of the rod 53 and has a channel 59 extending transversely to the connecting rod 53 for receiving therein a roller 60 which is rotatably mounted on a free end of a first pivot lever 61. The lever 61 is pivotably mounted on a shaft 62 secured to the frame 19 and has a lateral projection 63. A second pivot lever 64 is pivotably mounted on the shaft 62 and includes a lateral projection 65 supporting thereon a roller 66. A tension spring 67 extends between the second pivot lever 64 and a pin 68 disposed in the head of the frame 19 so as to urge the second pivot lever 64 to rotate in the clockwise direction in FIG. 1, thereby holding the roller 66 in rolling engagement with a lower surface of the lateral projection 63. A pair of links 69, 70 is pivoted at one end to the second pivot lever 64 in spaced relation with one another and, at the other end, to the pusher bars 43, 45, respectively.

The parts feeders 41 of the first and second parts-supply mechanisms 14, 15 are also coperatively connected to the drive mechanism 16 to feed the fastener elements A, B in timed relation to the punch mechanism 13. The structure and operation of a linkage between the parts feeders and the drive mechanism 16 is not essential to the invention and needs no detailed description.

Figure 3:
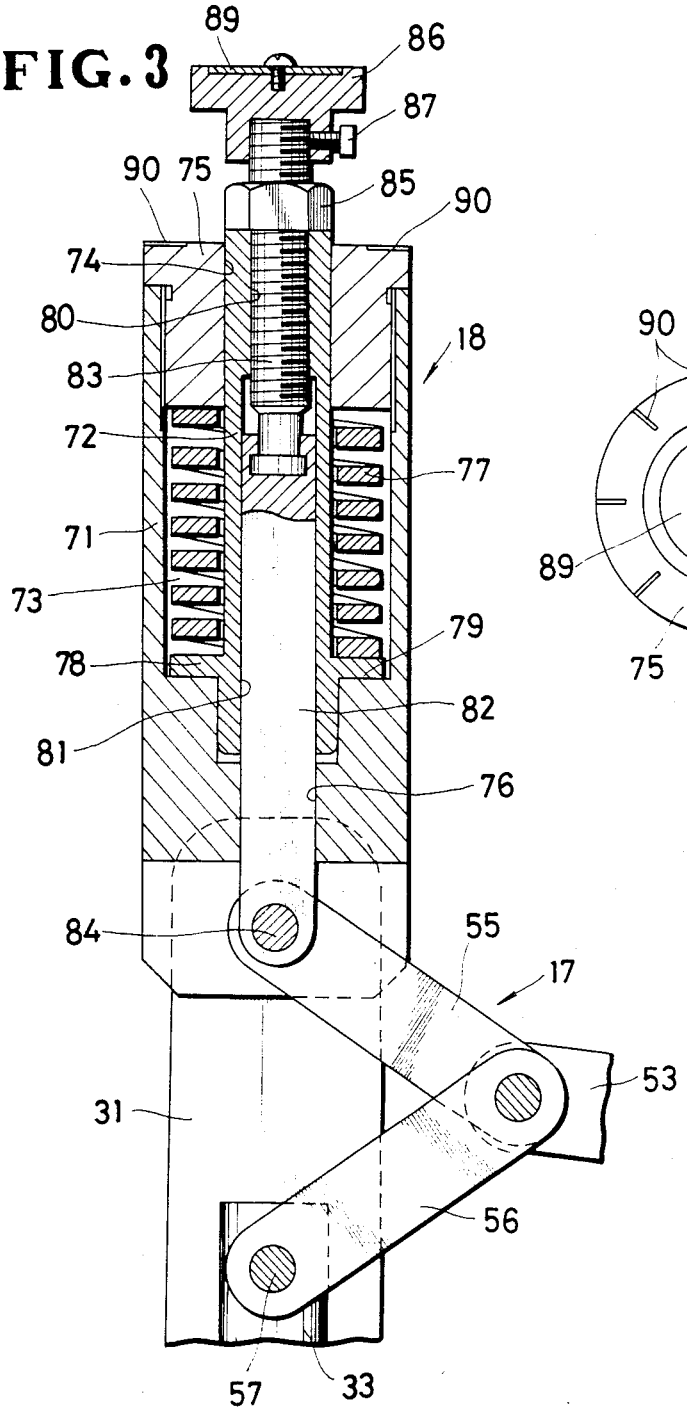
FIG. 3 is an enlarged cross-sectional view of a portion of the apparatus.

As shown in FIGS. 1 and 3, the shock absorbing means 18 includes a tubular casing 71 mounted on the frame's head portion 31 above the plunger 33, and a flanged holder 72 disposed in a stepped bore 73 in the casing 71. The holder 72 extends upwardly slidably through a central axial hole 74 in an end plug 75 which is fastened to an upper end of the tubular casing 71 to close the upper end of the stepped bore 73. A lower end of the stepped bore 73 communicates with a coaxial hole 76 opening to a lower end of the casing 71. A compression coil spring 77 is fitted loosely over the holder 72 and interposed between the end plug 75 and a flange 78 of the holder 72 to urge the flange 78 against a step or shoulder 79 of the stepped bore 73. The holder 72 has a pair of aligned upper and lower holes 80, 81 extending longitudinally from opposite ends of the holder 72 and communicating with each other. The upper hole 80 is threaded throughout the length thereof and the lower hole 81 preferably has a non-circular cross section. A slide bar 82 extends through the hole 76 into the lower hole 80 and is connected at its upper end to the lower end of an adjustment screw 83 which is threaded into the threaded hole 80. The holder 72 and the slide bar 82 thus connected jointly constitute a piston.

Figure 4:
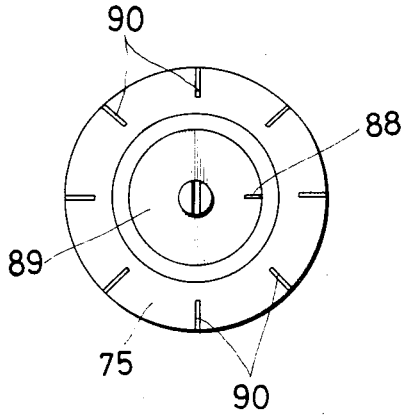
FIG. 4 is a top view of the upper end of FIG. 3.

The lower end of the adjustment screw 83 has a T-shaped axial cross section and is rotatably received in a transverse slot formed in the upper end of the slide bar 82, the transverse slot having a T-shaped cross section complemental with the cross section of the screw's lower end. With this arrangement, the slide bar 82 is longitudinally movable along the hole 80 in response to rotation of the adjustment screw 83. The slide bar 82 is pivotably connected at its lower end to the free end of the upper lever 55 of the toggle joint 17 by means of a pin 84. The adjustment screw 83 projects upwardly from the holder 72 and a nut 85 is threaded on the adjustment screw 83 to secure the latter to the holder 72. A knob 86 is secured to an upper end of the adjustment screw 83 by means of a set screw 87. The holder 72, the slide bar 82, the adjustment screw 83 and the lock nut 85 jointly constitute means for adjusting the stroke of the plunger 33 and hence the clinching punch 35. The stroke adjusting means includes a scale as shown in FIG. 4, which is composed of a reference mark 88 on a circular disc 89 secured to the top surface of the knob 86, and a series of angularly spaced notches 90 in an upper end surface of the end plug 75.

To adjust the stroke of the plunger 33, the nut 85 is loosened to allow rotation of the adjustment screw 83. Then the adjustment screw 83 is rotated in either clockwise or counter-clockwise direction to move the slide bar 83 toward or away from the plunger 33 until the reference mark 88 on the knob 86 reaches to a desired angular position with respect to the notches 90. During such adjustment, the holder 72 is kept immovable under the force of the spring 77.

The apparatus 10 operates as follows: The cylinder 49 is actuated to extend the piston rod 52 whereupon the toggle joint 17 extends its levers 55, 56 as indicated by phantom lines in FIG. 1, thereby clinching the fastener elements A, B between the punch 35 and the die 1. At the same time, the forward movement of the piston rod 52 causes the levers 61, 64 to pivot about the shaft 62 in the counter-clockwise direction in FIG. 1, thereby bringing the pusher bars 43, 45 from respective advanced positions to respective retracted positions indicated by phantom line in this figure. Then, one fastener element A is supplied from the parts feeder 41 through the chute 42 into the channel 40 in the guide block 39. Likewise, one fastener element 13 is fed from the parts feeder (not shown) through the chute 47 into the channel 46 in the guide block 44. When the cylinder 49 is actuated to retract the piston rod 52, the toggle joint 17 contracts its levers 55, 56 to move the plunger 33 and hence the punch 35 away from the die 21. During that time, the pusher bars 43, 45 return the respective advanced positions to thereby push the fastener elements A, B along the channels 40, 46, respectively into the clamp assembly 25 and the gripping assembly 12.

Since the shock absorbing means 18 has the stroke adjusting means, the stroke of the punch 35 can be easily adjusted to accommodate changes in thicknesses of both the fastener elements and the garment to which the fastener elements are attached. When the fastener elements to be assembled jointly have a greater thickness, shock forces are caused in the punch assembly 13 because the punch 35 is stopped before reaching to its dead center. The spring 77 is compressed by such shock forces to absorb the same, thereby protecting the fastener elements A, B from being damaged between the punch 35 and the die 21.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for assembling a pair of fastener elements, comprising:

(a) a frame;

(b) a punch and a die assembly mounted on said frame in opposed relation to one another, said punch assembly being reciprocable with respect to said die assembly to fasten the pair of fastener elements together;

(c) a drive mechanism mounted on said frame and operatively connected to said punch assembly to reciprocate the same, said drive mechanism including a toggle joint having a pair of levers pivoted together at one end, the free end of one of said levers being connected to said punch assembly; and (d) a combined shock-absorbing and stroke adjusting mechanism acting between said frame and the free end of the other of said levers, said combined mechanism includng:

(1) a tubular casing secured to said frame;

(2) a hollow cylindrical holder slidably supported in said casing;

(3) resilient shock-absorbing means disposed in said casing and acting between said casing and said holder and biasing said holder toward said free end of said other of said levers; and (4) a slide bar movably mounted in said hollow cylindrical holder and having one end adjustably secured to said slidable holder and its other end pivotably connected to said free end of said other lever;

whereby said holder and said slide bar are movable in unison away from said punch and die assembly against the resiliency of said shock-absorbing means, and said slide bar is axially adjustable relative to said holder.

2. An apparatus according to claim 1, said hollow cylindrical holder having an external annular flange against which said resilient shock-absorbing means acts.

3. An apparatus according to claim 1, including an adjustment screw threaded into said one end of said hollow cylindrical holder, said screw being rotatably connected to said slide bar.

4. An apparatus according to claim 3, including a knob carried on a projecting end of said adjustment screw and bearing reference means for indicating the angular position thereof, whereby an indication of the stroke is made.

* * * * *